US009193516B2

(12) United States Patent
Hiner

(10) Patent No.: US 9,193,516 B2
(45) **Date of Patent: *Nov. 24, 2015**

(54) APPARATUS FOR INSULATING AND/OR CARRYING A BEVERAGE CONTAINER

(71) Applicant: Ryan Hiner, Pasadena, MD (US)

(72) Inventor: Ryan Hiner, Pasadena, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/075,877

(22) Filed: Nov. 8, 2013

(65) Prior Publication Data

US 2014/0131373 A1 May 15, 2014

Related U.S. Application Data

(63) Continuation-in-part of application No. 13/678,392, filed on Nov. 15, 2012, now Pat. No. 8,757,427.

(51) Int. Cl.

| | |
|---|---|
| ***B65D 23/08*** | (2006.01) |
| ***B65D 81/38*** | (2006.01) |
| ***B65D 23/10*** | (2006.01) |

(52) U.S. Cl.

CPC ..... *B65D 81/3876* (2013.01); *B65D 23/104* (2013.01); *A45C 2200/20* (2013.01); *A45F 2200/0583* (2013.01); *B65D 2313/02* (2013.01)

(58) Field of Classification Search

CPC ..... B65D 23/08; B65D 23/0892; B65D 23/0842; B65D 25/24; B65D 25/36

USPC ..... 220/739, 903, 737, 738; 215/386, 12.1; 229/89

See application file for complete search history.

(56) References Cited

U.S. PATENT DOCUMENTS

| | | | |
|---|---|---|---|
| 1,114,537 | A | 10/1914 | Schorling |
| 4,401,245 | A | 8/1983 | Zills |
| 5,680,958 | A | 10/1997 | Mann et al. |
| 5,915,580 | A | 6/1999 | Melk |
| 6,073,796 | A | 6/2000 | Mogil |
| D595,994 | S | 7/2009 | Albritton |
| D614,001 | S | 4/2010 | Welch |
| D666,060 | S | 8/2012 | Welch |
| 2002/0104845 | A1 | 8/2002 | Beuke |
| 2002/0108960 | A1 | 8/2002 | Watson |
| 2004/0182870 | A1 | 9/2004 | Rodgers |
| 2005/0279751 | A1 | 12/2005 | Dempsey |
| 2007/0017924 | A1 | 1/2007 | Hundley |

*Primary Examiner* — Stephen Castellano

(74) *Attorney, Agent, or Firm* — Matthew A. Pequignot; Pequignot & Myers LLC

(57) ABSTRACT

Apparatus for carrying or covering a beverage container which is adjustable in form. In certain embodiments, apparatus for carrying and/or covering a beverage container which provides insulative properties and which is so structurally designed so as to capable of being alternately configured to fit a can or a bottle.

7 Claims, 5 Drawing Sheets

APPARATUS FOR INSULATING AND/OR CARRYING A BEVERAGE CONTAINER

RELATED APPLICATION DATA

This application is a continuation-in-part of U.S. patent application Ser. No. 13/678,392, filed on Nov. 15, 2012, now U.S. Pat. No. 8,757,427, and entitled APPARATUS FOR INSULATING AND/OR CARRYING A BEVERAGE CONTAINER. All claims of priority to this application are hereby made, and this application is hereby incorporated in its entirety by reference.

FIELD OF INVENTION

This invention relates to apparatus for carrying or covering a beverage container which is adjustable in form. In certain embodiments, this invention relates to apparatus for carrying and/or covering a beverage container which provides insulative properties and which is so structurally designed so as to capable of being alternately configured to fit a can or a bottle.

BACKGROUND OF THE INVENTION

A conventional beverage can or beverage bottle has historically been constructed from glass or a metal such as aluminium. In years past, the end use of such beverage containers by a person consuming a beverage presented various problems. For example, the body heat of a hand holding a beverage container would transmit through the glass or metal of the beverage container, thus undesirably altering the temperature of the beverage (e.g., often by accelerating the warming of a previously chilled beverage). Moreover, if a beverage can was chilled in an ice chest, for example, then the metal of the can (or glass in the case of a bottle) could reach temperatures which were so low or cold so as to be uncomfortable to the touch of a human hand.

In order to address these problems related to the use of beverage containers, various inventions have heretofore been used to insulate beverage containers to not only maintain the desired temperature of a beverage but also to provide comfort to the person carrying or consuming the beverage. One example of such an invention is a polystyrene cylinder or sleeve—popularized in the 1980's—for carrying and simultaneously insulting a beer or soda can. Subsequent to the development of polystyrene beverage container insulators, different materials, such as neoprene or ethylene vinyl acetate ("EVA") foam, have been experimented with and have since become popular for use as such insulators. Regardless of construction, such beverage container insulators are today often referred to as beer jackets or sleeves, beer huggers or huggies, cozies, coosies, or koozies.

While the beverage container insulators which have been previously known in the art perform basic insulation functions reasonably well, known container insulators suffer various drawbacks. For example, there remains a need in the art for a container insulator which is reconfigurable to fit or conform to both bottles and cans. Moreover, there is a need in the art for a reconfigurable container insulator which also provides carrying handles or straps in both bottle and can carrying configurations.

In view of these and other desires for improvements in the art, it is a purpose of the herein described invention to address one or more of such desires as well as, or in the alternative, other needs which will become more apparent to the skilled artisan once given the present disclosure.

SUMMARY OF CERTAIN EXAMPLES OF THE INVENTION

Generally speaking, this invention relates to apparatus or devices (or methods for using such devices or apparatus) which provide beverage container carrying and/or insulating capabilities. In certain embodiments, such apparatus or devices can be configured into at least two different configurations for carrying beverage containers of different types (for example, cans and bottles).

In at least one embodiment, an apparatus is provided comprising: a cylindrical container comprised of a cylindrically formed wall of insulative material, the cylindrical container having a variable diameter where a bottom region of the cylindrical container has a larger diameter than a top region, and wherein the top region of the cylindrical container has an open-end; the cylindrically formed wall having an interior wall surface and an exterior wall surface; the cylindrically formed wall having an upper region with an openable and closable vertically oriented seam which extends from the open-end at the top region of the cylindrical container to a lower region of the cylindrical container; the interior wall surface of the cylindrically formed wall having a first adhesive portion thereon located substantially opposite the location of the vertically oriented seam and proximal the top region, the interior wall surface further including second and third adhesive portions generally flanking the first adhesive portion; a first elongated strap having a first end fixedly connected proximal the top region of the cylindrical container in relative circumferential alignment with the location of the first adhesive portion and a second attachable and detachable end which includes a fourth adhesive portion thereon; the exterior wall surface of the cylindrically formed wall having a fifth adhesive portion located at a bottom region thereof in general circumferential alignment with the location of connection of the first end of the first elongated strap; a second elongated strap having a first end connected proximal the bottom region of the exterior wall surface of the cylindrical container and a second end connected proximal a central region of the exterior wall surface of the cylindrical container, the second elongated strap being attached to the exterior wall surface in a generally vertical orientation spaced a select circumferential distance from the location of the first elongated strap; and wherein the cylindrical container is so structurally designed such that it is selectively configurable into two configurations, the two configurations comprising: a first configuration wherein the vertically oriented seam is closed, which is suitable for carrying a bottle; and a second configuration wherein the vertically oriented seam is open, and the top portion of the cylindrical container is folded downwards, which is suitable for carrying a can.

In other embodiments, alone or in combination with the other features described above, the apparatus is configured such that when the vertically oriented seam is open, the upper region of the cylindrically formed wall includes first and second corner regions, the interior wall surface portion of the first corner region having the second adhesive portion located thereon and the interior wall surface portion of the second corner region having the third adhesive portion located thereon; and wherein, when the cylindrical container is configured into the second configuration, the first and the second corner regions are folded over, in a direction towards the first adhesive portion, so that the second and third adhesive portions are each adhesively connected to the first adhesive portion.

In other embodiments, alone or in combination with the other features described above or below, the apparatus is configured such that when the cylindrical container is in the second configuration, the fourth adhesive portion of the second end of the first elongated strap is adhesively connected to the fifth adhesive portion such that a first handle is formed for carrying the cylindrical container when a can is installed in the cylindrical container.

In other embodiments, alone or in combination with the other features described above or below, the apparatus is configured such that the second elongated strap provides a second handle for carrying the cylindrical container when a bottle is installed in the cylindrical container in the first configuration in which the vertically oriented seam is closed.

In other embodiments, alone or in combination with the other features described above or below, when the cylindrical container is configured into the first configuration, the fourth adhesive portion of the second end of the first elongated strap is adhesively connectable to a sixth adhesive portion located on the exterior wall surface of the cylindrically formed wall at a located generally circumferentially in-line with the located of the first adhesive region, thereby to form a loop from the first elongated strap for hanging the cylindrical container from a point of attachment.

In other embodiments, alone or in combination with the other features described above or below, the first, second, third, fourth, fifth, and sixth adhesive portions are hook and loop fasteners.

In other embodiments, alone or in combination with the other features described above or below, the vertically oriented seam includes a zipper installed thereon for opening and closing the vertically oriented seam.

In at least one embodiment, a beverage container carrying apparatus is provided which has a substantially uniform diameter which, rather than being designed to carry, alternately, a bottle or a can-type container, is sized to alternate between configurations suitable for carrying different sized cans (e.g., 16 oz, 20 oz. and/or 24 oz. cans). In at least one of such embodiments, there is provided: apparatus comprising a cylindrical container comprised of a cylindrically formed wall of insulative material, the cylindrical container having a generally uniform diameter where a bottom region of the cylindrical container has a diameter which is generally the same as a top region, and wherein the top region of the cylindrical container has an open-end; the cylindrically formed wall having an interior wall surface and an exterior wall surface; the cylindrically formed wall having an upper region with an openable and closable vertically oriented seam which extends from the open-end at the top region of the cylindrical container to a lower region of the cylindrical container; the interior wall surface of the cylindrically formed wall having a first adhesive portion thereon located substantially opposite the location of the vertically oriented seam and proximal the top region, the interior wall surface further including second and third adhesive portions generally flanking the first adhesive portion; a first elongated strap having a first end fixedly connected proximal the top region of the cylindrical container in relative circumferential alignment with the location of the first adhesive portion and a second attachable and detachable end which includes a fourth adhesive portion thereon; the exterior wall surface of the cylindrically formed wall having a fifth adhesive portion located at a bottom region thereof in general circumferential alignment with the location of connection of the first end of the first elongated strap; a second elongated strap having a first end connected proximal the bottom region of the exterior wall surface of the cylindrical container and a second end connected proximal a central region of the exterior wall surface of the cylindrical container, the second elongated strap being attached to the exterior wall surface in a generally vertical orientation spaced a select circumferential distance from the location of the first elongated strap; and wherein the cylindrical container is so structurally designed such that it is selectively configurable into two configurations, the two configurations comprising: a first configuration wherein the vertically oriented seam is open, and the top portion of the cylindrical container is folded downwards, which is suitable for carrying a can having a first height x; and a second configuration wherein the vertically oriented seam is closed, which is suitable for carrying a can having a second height y, wherein the height y is greater than the height x.

In at least one additional embodiment, a pocket is provided on one or more of the container carrying apparatus described herein, so located, sized, and configured so as to be useful for carrying one or more cards or paper money. In some embodiments, the optional pocket is a solid faced material such as a flexible or deformable plastic. In other embodiments, the optional pocket may be a mesh fabric material so as to provide stretchability for variable carrying capacity.

Certain examples of the invention are now described below with respect to certain non-limiting embodiments thereof as illustrated in the following drawings wherein:

BRIEF DESCRIPTION OF CERTAIN EXAMPLE DRAWINGS

The drawings submitted with and which form a part of this patent application each illustrate an embodiment, or one or more components of an embodiment, of a non-limiting example of Applicant's invention. While these drawings depict certain preferred embodiments of Applicant's invention, as well as certain particularly desirable features thereof, they are intended to be examples only and should not be construed to limit the scope of Applicant's invention.

DESCRIPTION OF CERTAIN NON-LIMITING EXAMPLE EMBODIMENTS

For a more complete understanding of the present invention, reference is now made to the following description of various illustrative and non-limiting embodiments thereof, taken in conjunction with the accompanying drawings in which like reference numbers indicate like features.

Referring now to FIGS. 1-6, a non-limiting, example embodiment of the inventive apparatus is depicted therein. Generally speaking, the apparatus illustrated in these figures comprises a beverage container carrying apparatus 1, constructed from a cylindrically formed wall 3, which itself is preferably formed from an insulative material such as neoprene or rubber (other material types, are, of course, acceptable). As may be seen in these figures, apparatus 1 is particularly structurally designed so that it may be configured into at least two distinct configurations; a first for carrying a bottle-type beverage container (see, e.g., FIGS. 1-2) and a second for carrying a can-type beverage container (see, e.g., FIGS. 5-6), respectively.

Figure 2:
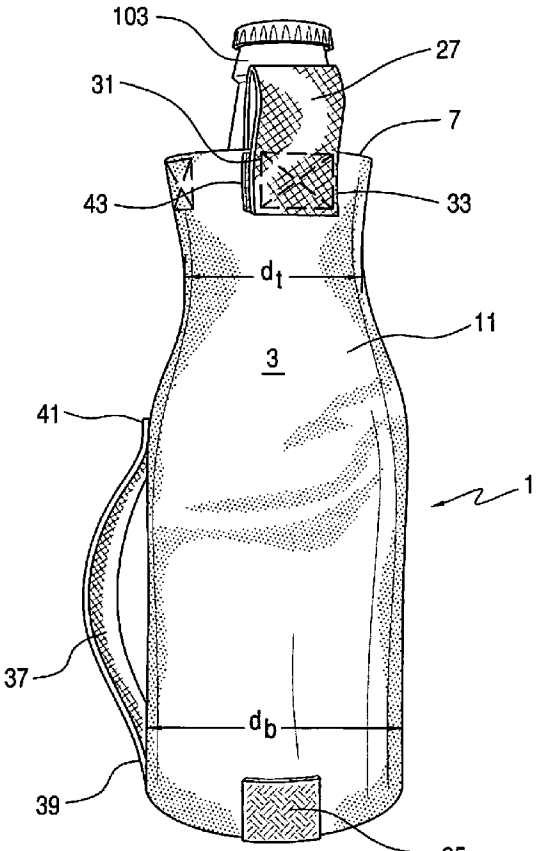
FIG. 2 illustrates the embodiment of the beverage container carrying apparatus depicted in FIG. 1, with the human hand removed for sake of clarity.

Lending to this capability, the illustrated example embodiment has top and bottom regions of differing diameters, shown as $d_t$ and $d_b$ respectively in FIG. 2 (i.e., the top region has a smaller overall diameter than the bottom region). Moreover, carrying apparatus 1 has a vertically oriented seam 15 which begins at the top region of wall 3 at the apparatuses open end 7 and extends downwardly to a lower region of the wall. Seam 15 is openable and closeable by a user, such as by a zipper 17, in the illustrated embodiment (closure mechanisms other than zippers may, of course, be employed).

Figure 1:
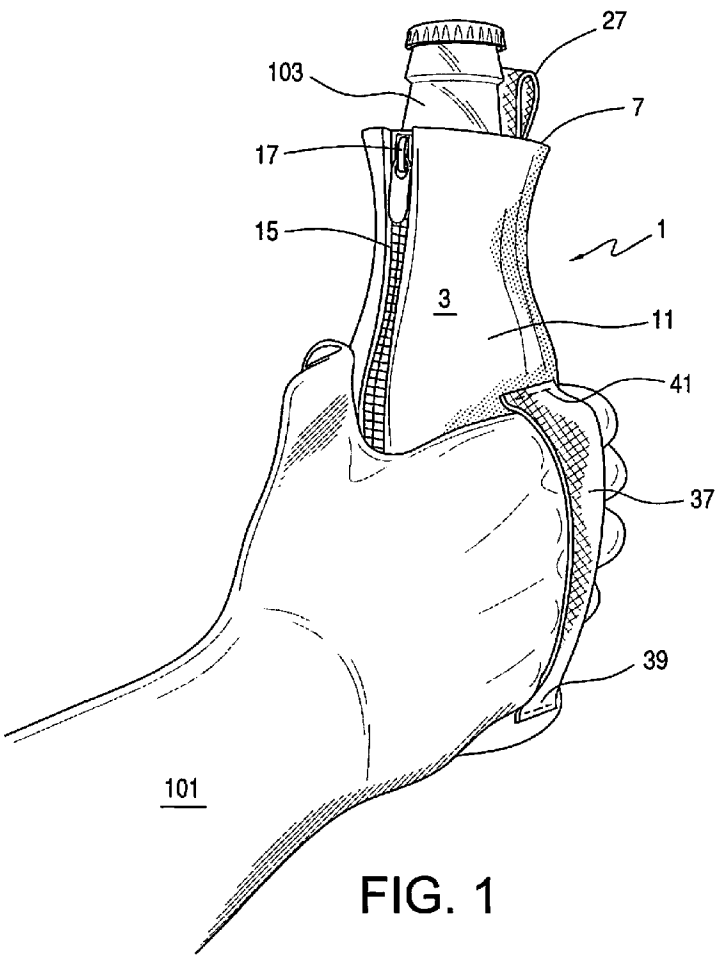
FIG. 1 illustrates one embodiment of a beverage container carrying apparatus according to the subject invention, configured for carrying a bottle-type container, shown held by a human hand.
Figure 3:
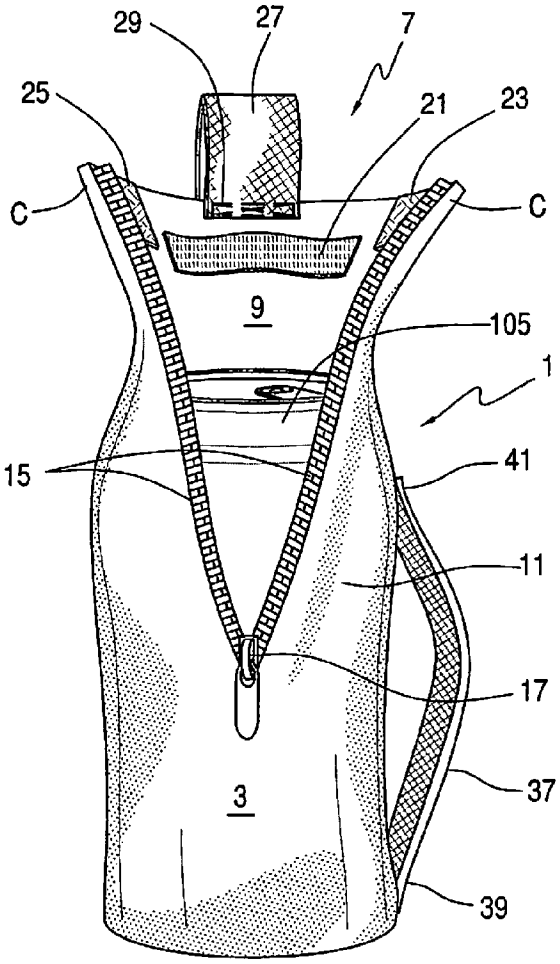
FIG. 3 illustrates the embodiment of the beverage container carrying apparatus depicted in FIG. 1 with the vertically oriented zipper region open during a process of reconfiguring the embodiment to carry a can-type beverage container.

When seam 15 is in a closed or sealed state, apparatus 1 is configured to carry a bottle-type beverage container, such as bottle 103 depicted in FIGS. 1 and 2. When a bottle is installed such as shown, the insulative properties of wall 3 insulate bottle 103 and thereby aid in maintaining a constant or desired temperature of the beverage contained within the container. Moreover, wall 3 provides a comfortable gripping surface which shields a human hand 101 from cold, for example. As shown in FIGS. 1-2, apparatus 1 further preferably includes an elongated strap 37 with a first end 37 connected to a bottom region (i.e., exterior wall surface 11) of wall 3 and a second end 41 connected to, or proximal to, a central region of apparatus 1, preferably also to exterior wall surface 11 of wall 3. Strap 37, as shown in FIG. 1, aids in securing apparatus 1 to a human hand, such as hand 101, when the apparatus is being used to carry a bottle.

Apart from providing the capability of carrying a bottle-type beverage container, apparatus 1 can be reconfigured into a second configuration state to carry a can-type beverage container (e.g., can 105), such as shown in FIGS. 3-6. By first unzipping seam 15 using zipper 17, interior wall surface 9 becomes visible which, as shown in the drawings, contains or includes a first adhesive portion 21 located on the portion of wall surface 9 generally oppositely facing seam 15. Flanking each side of portion 21 are two additional adhesive portions 23 and 25. With seam 15 unzipped, as shown, wall 3 reveals two corner regions "c" at which adhesive portions 23 and 25 are preferably located.

Figure 4:
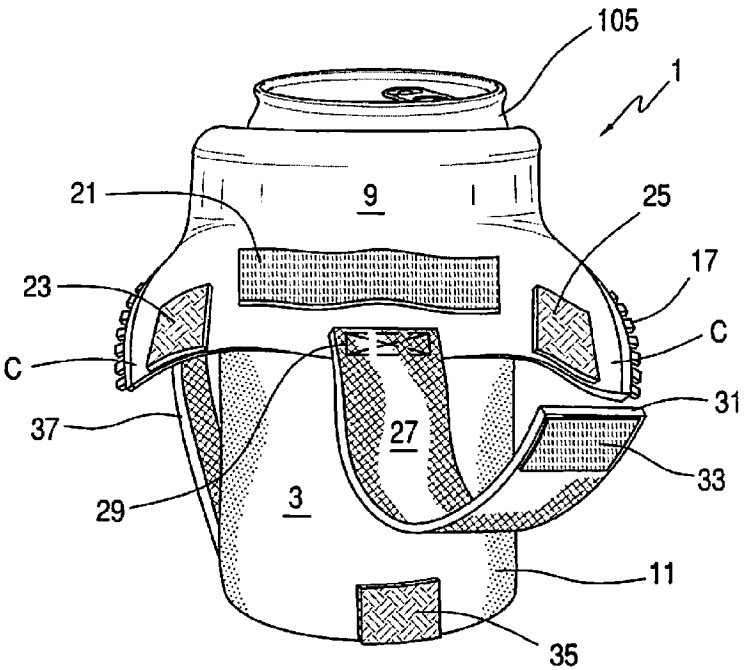
FIG. 4 illustrates the embodiment of the beverage container carrying apparatus depicted in FIG. 3 with the top region folded downwards during a process of reconfiguring the embodiment to carry a can-type beverage container.
Figure 6:
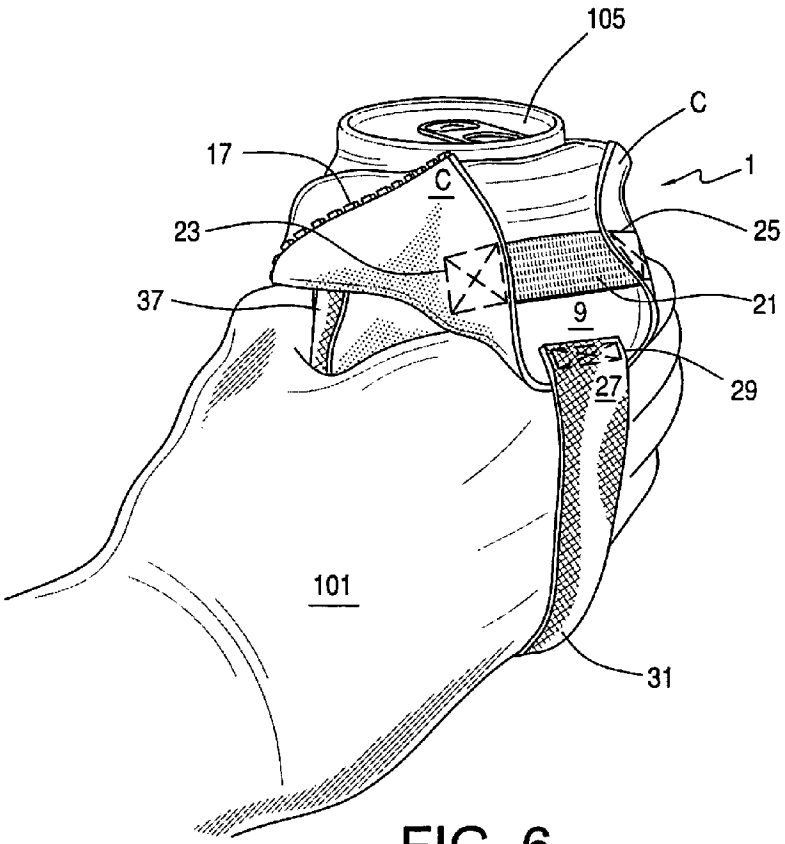
FIG. 6 illustrates the embodiment of the beverage container carrying apparatus depicted in FIG. 5, shown held by a human hand.
Figure 5:
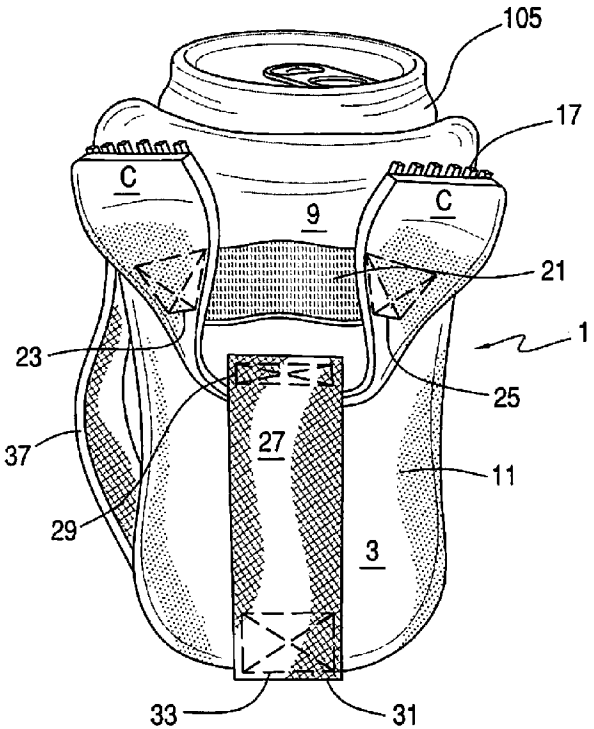
FIG. 5 illustrates the embodiment of the beverage container carrying apparatus depicted in FIG. 3 fully reconfigured to carry a can-type beverage container.

In the next step of transforming apparatus 1 into a second configuration state, the top region of wall 3 is folded downwards, such as shown in FIG. 4, preferably by using corners "c" as hand-holds or levers to fold the wall surfaces downward. When a can, such as can 105, is installed in the apparatus, the top portion of the can becomes accessible which is important so that the drinking region of the can may be accessed by a human beverage consumer. Next, elongated strap 27, which is connected at its first end 29 to interior wall 9 (but may be connected elsewhere or in a different manner), is fastened to wall 3 by way of adhesive portion 33 (located on the second end 31 of the strap), which itself is located at or proximal the bottom region of the apparatus, preferably on exterior wall 11. Finally, as depicted in FIGS. 5-6, corners "c" are folded over again to connect adhesive portions 23 and 25 to adhesive portion 21, thereby completing the transformation of the apparatus into a can carrying configuration. As can be seen best in FIG. 6, with corners "c" folded over and fastened, and with strap 27 connected at its second end to exterior wall 11, a handle and/or gripping region is formed so that the apparatus may be securely carried by a human hand (e.g., hand 101).

In order to return apparatus 1 to a bottle-carrying configuration, the reverse operation may, of course, be employed. However, when used, seam 15 is not closed until preferably after a bottle is inserted via open end 7 into the carrying/insulating apparatus. Optionally, when in the bottle carrying configuration, an additional adhesive portion 43 may be included, and strap 27 affixed thereto (at end 31 via adhesive portion 33), to thereby provide a loop region, such as depicted in FIG. 2, so that apparatus 1 can be hung on a hook or a belt-loop or other surface, for example.

Figure 7:
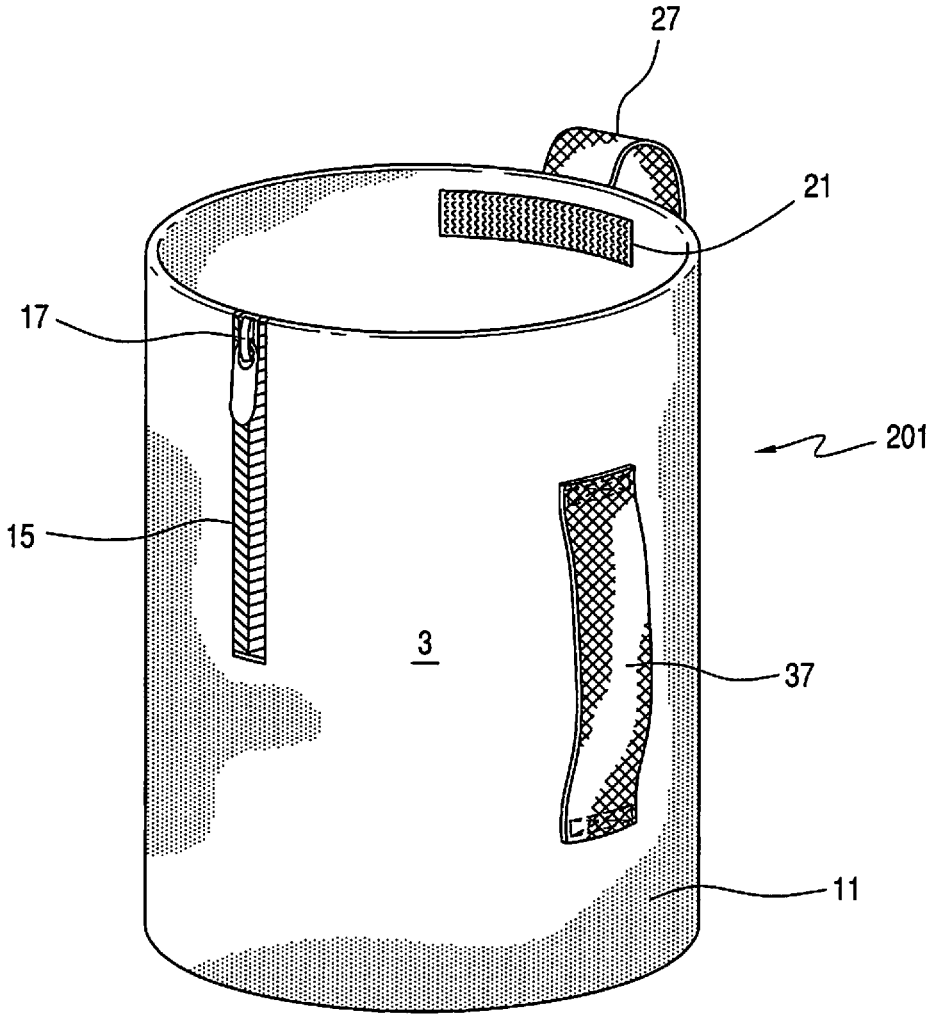
FIG. 7 illustrates an alternative embodiment of a beverage container carrying apparatus in which the diameter of the example cylindrical container is substantially or completely uniform.

Turning now to FIG. 7, an alternative embodiment of a beverage container carrying apparatus is disclosed therein as container 201. While container 201 is otherwise very similar to apparatus 1, it has a cylindrical diameter which is generally or substantially or completely uniform, unlike the variable diameter described with respect to the above embodiments. Configured with such a uniform diameter, container 201 is designed to be reconfigured between at least two configurations such as suitable for carrying different sized cans (e.g., 16 oz, 20 oz. and/or 24 oz. cans). The parts and reconfiguration steps for container 201 are otherwise substantially the same as the parts and steps for apparatus 1, therefore, container 201 is shown with the same part numbers as those discussed in detail above (with respect to apparatus 1).

Figure 8:
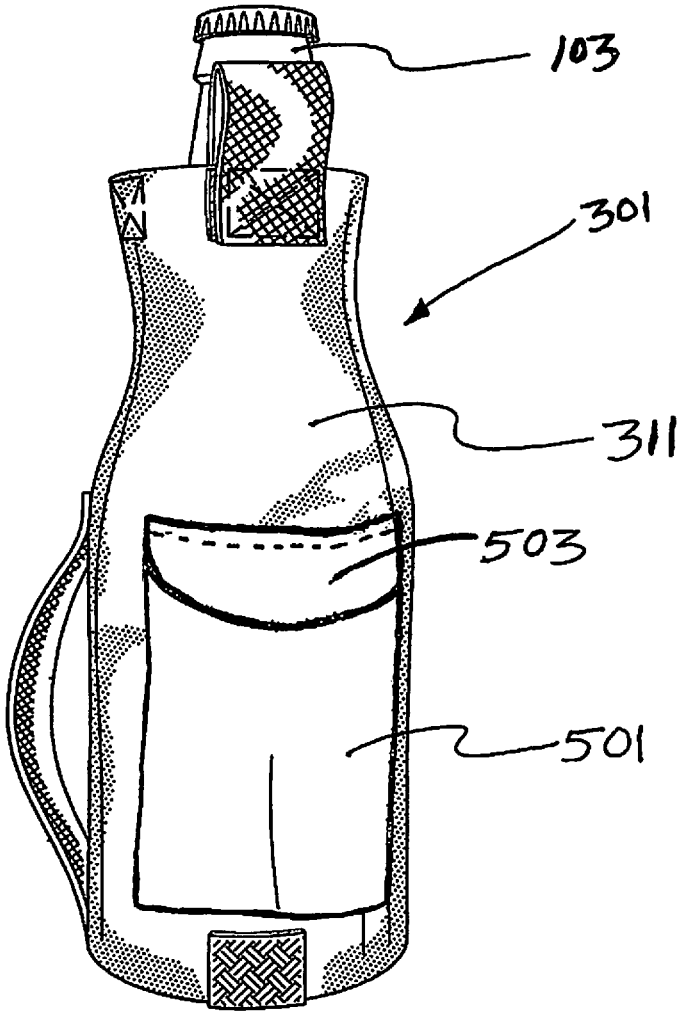
FIG. 8 illustrates a further alternative embodiment of a beverage container carrying apparatus which includes one or more exterior pockets such as depicted.

A further alternative embodiment of a beverage container carrying apparatus is disclosed in FIG. 8. Container 301, as depicted in FIG. 8, is essentially identical to container apparatus 1, shown in FIGS. 1-6, except apparatus 301 includes the addition of a pocket 501 located on an exterior wall 311 of the container. Pocket 501, in this regard, includes an upper opening 503 and is suitably sized and configured to carry cards, such as identification cards or drivers licenses, credit cards, business cards, and the like. Pocket 501 can be of any other size and configuration, however, such as (for example) with a deeper pocket to carry a larger amount or thickness of cards (or cash money, for example). Additionally, such a pocket need not be a fully external to the surface of exterior wall 311, but may also be integrated within the wall surface (fully or partially) and may also closeable such as with a zipper or hook and loop closures. Moreover, pocket 501 may be positioned in other locations or orientations on container apparatus 301, such as oriented so that the pocket opening is on a side (or in the center) rather than an upper portion of the pocket. Further still, pocket 501 may be included on other variations of beverage container carrying apparatus, such as the embodiment of an apparatus disclosed in FIG. 7.

In embodiments which include a pocket, the optional pocket may be a solid faced material such as a flexible or deformable plastic. In other embodiments, the optional pocket may be a mesh fabric material so as to provide stretchability for variable carrying capacity. Of course, many other pocket construction varieties are contemplated and still considered to be within the scope of the present invention(s).

While the adhesive portions illustrated in the above-described figures are conventional hook and loop type fasteners (such as sold under the tradename VELCRO), other adhesive or fastener types may of course be employed with the present invention. Moreover, just as seam 15's closing mechanism need not be a zipper (but could be hook and loop fastener or a chemical adhesive type fastener) additional materials (or mixtures thereof), other than neoprene, may of course be employed to construct wall 3. Additionally, while some portions, such as adhesive portion 35, are shown in circumferential alignment with other portions, such as strap 27, variations of these positions may of course be used as desired. For example, the precise location of adhesive portion 35 could be moved circumferentially from side-to-side to specifically accommodate right or left handed individuals, if desired.

The term circumferential alignment, in this regard, is defined herein as a similar or same position of a component or components along the circumference of the cylinder formed by wall 3 (which need not be perfectly round or cylindrical) irrespective of the differing diameters of the top and bottom regions and regardless of the location near the top or bottom region or portion of the apparatus. That is, even though the top region's diameter is smaller than the bottom region's diameter, in this embodiment, strap 27 (for example) is defined as to be in circumferential alignment with adhesive portion 35 because they are generally vertically aligned (in at least one plane) when following the profile of exterior surface 11 upwards or downwards. The term "vertical" (or "vertically") in this regard, in addition to as when used in reference to seam 15, only applies when apparatus 1 is oriented in an upright state, such as shown in FIG. 1. The important characteristic, at least with regard to seam 15, is not that it is "vertical" but that it extends generally from the top, open end 7 of the apparatus to a distal region generally located near a central portion of wall 3 (without, for example, requiring that seam 15 be linear or perfectly inline or "in plane" with the central axis of the apparatus).

Once given the above disclosure, many other features, modifications, and improvements will become apparent to the skilled artisan. Such features, modifications, and improvements are therefore considered to be part of this invention, without limitation imposed by the example embodiments described herein. Moreover, any word, term, phrase, feature, example, embodiment, or part or combination thereof, as used to describe or exemplify embodiments herein, unless unequivocally set forth as expressly uniquely defined or otherwise unequivocally set forth as limiting, is not intended to impart a narrowing scope to the invention in contravention of the ordinary meaning of the claim terms by which the scope of the patent property rights shall otherwise be determined.

I claim:

1. Apparatus comprising:

a cylindrical container comprised of a cylindrically formed wall of insulative material, said cylindrical container having a variable diameter where a bottom region of said cylindrical container has a larger diameter than a top region, and wherein said top region of said cylindrical container has an open-end;

said cylindrically formed wall having an interior wall surface and an exterior wall surface;

said cylindrically formed wall having an upper region with an openable and closable vertically oriented seam which extends from said open-end at said top region of said cylindrical container to a lower region of said cylindrical container;

said interior wall surface of said cylindrically formed wall having a first adhesive portion thereon located substantially opposite the location of said vertically oriented seam and proximal said top region, said interior wall surface further including second and third adhesive portions generally flanking said first adhesive portion;

a first elongated strap having a first end fixedly connected proximal said top region of said cylindrical container in relative circumferential alignment with the location of said first adhesive portion and a second attachable and detachable end which includes a fourth adhesive portion thereon;

said exterior wall surface of said cylindrically formed wall having a fifth adhesive portion located at a bottom region thereof in general circumferential alignment with the location of connection of said first end of said first elongated strap;

a second elongated strap having a first end connected proximal said bottom region of said exterior wall surface of said cylindrical container and a second end connected proximal a central region of said exterior wall surface of said cylindrical container, said second elongated strap being attached to said exterior wall surface in a generally vertical orientation spaced a select circumferential distance from the location of said first elongated strap; and wherein said cylindrical container is so structurally designed such that it is selectively configurable into two configurations, said two configurations comprising:

a first configuration wherein said vertically oriented seam is closed, which is suitable for carrying a bottle;

a second configuration wherein said vertically oriented seam is open, and said top portion of said cylindrical container is folded downwards, which is suitable for carrying a can; and further including a pocket, located on said cylindrical container, so sized and configured for carrying one or more cards or paper money.

2. Apparatus according to claim 1 wherein said vertically oriented seam is open, said upper region of said cylindrically formed wall includes first and second corner regions, said interior wall surface portion of said first corner region having said second adhesive portion located thereon and said interior wall surface portion of said second corner region having said third adhesive portion located thereon; and wherein, when said cylindrical container is configured into said second configuration, said first and said second corner regions are folded over, in a direction towards said first adhesive portion, so that said second and third adhesive portions are each adhesively connected to said first adhesive portion.

3. Apparatus according to claim 2 wherein, when said cylindrical container is configured into said second configuration, said fourth adhesive portion of said second end of said first elongated strap is adhesively connected to said fifth adhesive portion such that a first handle is formed for carrying said cylindrical container when a can is installed in said cylindrical container.

4. Apparatus according to claim 3 wherein said second elongated strap is configured to provide a second handle for carrying said cylindrical container when a bottle is installed in said cylindrical container in said first configuration in which said vertically oriented seam is closed.

5. Apparatus according to claim 4 wherein, when said cylindrical container is configured into said first configuration, said fourth adhesive portion of said second end of said first elongated strap is adhesively connectable to a sixth adhesive portion located on said exterior wall surface of said cylindrically formed wall at a located generally circumferentially in-line with the located of said first adhesive region, thereby to form a loop from said first elongated strap for hanging said cylindrical container from a point of attachment.

6. Apparatus according to claim 5 wherein said first, second, third, fourth, fifth, and sixth adhesive portions are hook and loop fasteners.

7. Apparatus according to claim 6 wherein said vertically oriented seam includes a zipper installed thereon for opening and closing said vertically oriented seam.

* * * * *